US007812511B2

(12) United States Patent
Liu et al.

(10) Patent No.: US 7,812,511 B2
(45) Date of Patent: Oct. 12, 2010

(54) FIELD EMISSION ILLUMINATION DEVICE

(75) Inventors: Peng Liu, Beijing (CN); Yang Wei, Beijing (CN); Kai-Li Jiang, Beijing (CN); Xiao-Bo Zhang, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 477 days.

(21) Appl. No.: 11/510,414

(22) Filed: Aug. 25, 2006

(65) Prior Publication Data

US 2007/0145878 A1 Jun. 28, 2007

(30) Foreign Application Priority Data

Dec. 23, 2005 (CN) ..... 2005 1 0121248

(51) Int. Cl.
*H01J 63/02* (2006.01)
*H01J 63/04* (2006.01)

(52) U.S. Cl. ..... 313/495

(58) Field of Classification Search ..... 313/336, 313/495, 496, 497, 310, 346 R
See application file for complete search history.

(56) References Cited

U.S. PATENT DOCUMENTS

| | | | | |
|---|---|---|---|---|
| 6,008,575 | A * | 12/1999 | Kaftanov et al. | 313/484 |
| 6,957,993 | B2 | 10/2005 | Jiang et al. | |
| 2004/0051432 | A1 | 3/2004 | Jiang et al. | |
| 2004/0053780 | A1 | 3/2004 | Jiang et al. | |
| 2004/0151835 | A1 | 8/2004 | Croci et al. | |
| 2005/0212402 | A1* | 9/2005 | Haba et al. | 313/496 |
| 2007/0144780 | A1 | 6/2007 | Jiang et al. | |
| 2007/0243124 | A1* | 10/2007 | Baughman et al. | 423/447.1 |
| 2008/0170982 | A1* | 7/2008 | Zhang et al. | 423/447.3 |

FOREIGN PATENT DOCUMENTS

| | | |
|---|---|---|
| CN | 2731902 Y | 10/2005 |
| JP | 2000164112 | 6/2000 |
| JP | 2002-172598 | 6/2002 |
| JP | 2004-107196 | 4/2004 |
| JP | 2004-111345 | 4/2004 |
| JP | 2004303521 A1 | 10/2004 |

(Continued)

OTHER PUBLICATIONS

Oxford English Dictionary radially, adv.pdf. Definition of radially.*

(Continued)

*Primary Examiner*—Nimeshkumar D Patel
*Assistant Examiner*—Steven Horikoshi
(74) *Attorney, Agent, or Firm*—Jeffrey T. Knapp

(57) ABSTRACT

A field emission illumination device includes a sealed tubular body, an anode layer, a fluorescence layer and an electron emitting cathode electrode. The sealed tubular body has a light-permeable portion and the anode is formed on an inner surface of the light-permeable portion of the tubular body. The fluorescence layer is formed on the anode layer. The electron emitting cathode is positioned in the tubular body and includes at least one carbon nanotube yarn. In the illuminating process the energy in the field emission illumination device only undergoes transformation from electric energy to luminous energy, so the efficiency of the energy transformation is increased.

11 Claims, 7 Drawing Sheets

FOREIGN PATENT DOCUMENTS

| | | |
|---|---|---|
| JP | 2007-128892 | 5/2007 |
| JP | 2008-523254 | 7/2008 |
| TW | 415799 | 12/2000 |
| TW | 563889 | 11/2003 |

OTHER PUBLICATIONS

Croci et al., "A fully sealed luminescent tube based on carbon nanotube field emission," 2004, Microelectronics Journal, 35, 329-336.*

* cited by examiner

FIELD EMISSION ILLUMINATION DEVICE

TECHNICAL FIELD

The present invention relates to illumination devices and, more particularly, to a field emission illumination device.

BACKGROUND

Illumination is indispensable in our everyday life. Commonly, incandescent lamps or fluorescent lamps are used for illuminating. Here we take the fluorescent lamp as an example.

A fluorescent lamp, which is one type of discharge lamps, includes a glass tube and some dischargeable gas, for example, argon and a little mercury vapor contained in the glass tube. Some fluorescent powder is spread on the inner surface of the glass tube. Two electrodes, i.e., an anode and a cathode, are disposed at the two ends of the glass tube. The two electrodes are formed by tungsten filaments. An example of luminescence in a fluorescent lamp is as follows.

A voltage is applied between the two electrodes and an electrical current is formed in the two electrodes. The two electrodes are heated by the electrical current and begin to discharge. Many electrons are generated by the discharging of the electrodes. The electrons move freely in the glass pipe and collide with atoms of the mercury vapor, and ultraviolet radiation is generated due to collisions between the electrons and the atoms of mercury vapor. The ultraviolet radiation excites the fluorescent powder on the inner surface of the glass tube and the fluorescent power generates a visible light.

However, the fluorescent lamp includes mercury vapor, which may cause pollution. The fluorescent lamp thus requires two energy transformation processes to emit light, from electric energy to luminous energy (generation of ultraviolet radiation) and from luminous energy to luminous energy (generation of the visible light by the fluorescent power), which has a low efficiency of energy transformation.

What is needed, therefore, is to provide an illumination device with higher efficiency of energy transformation.

SUMMARY

In a preferred embodiment of the present invention, a field emission illumination device includes a sealed tubular body, an anode layer, a fluorescence layer and an electron emitting cathode electrode. The sealed tubular body has a light-permeable portion and the anode is formed on an inner surface of the light-permeable portion of the tubular body. The fluorescence layer is formed on the anode layer. The electron emitting cathode is positioned in the tubular body and includes at least one carbon nanotube yarn.

The present field emission illumination device only requires one process of energy transformation, from electric energy to luminous energy, thus increasing the efficiency of energy transformation. In addition, the field emission illumination device doesn't include mercury vapor that is harmful to the environment.

Advantages and novel features will become more apparent from the following detailed description of the present field emission illumination device, when taken in conjunction with the accompanying drawings.

BRIEF DESCRIPTION OF THE DRAWINGS

Many aspects of the present field emission illumination device can be better understood with reference to the following drawings. The components in the drawings are not necessarily drawn to scale, the emphasis instead being placed upon clearly illustrating the principles of the present field emission illumination device. Moreover, in the drawings, like reference numerals designate corresponding parts throughout the several views.

DETAILED DESCRIPTION OF PREFERRED EMBODIMENTS

Reference will now be made to the drawings to describe preferred embodiment of the field emission illumination device.

Figure 1:
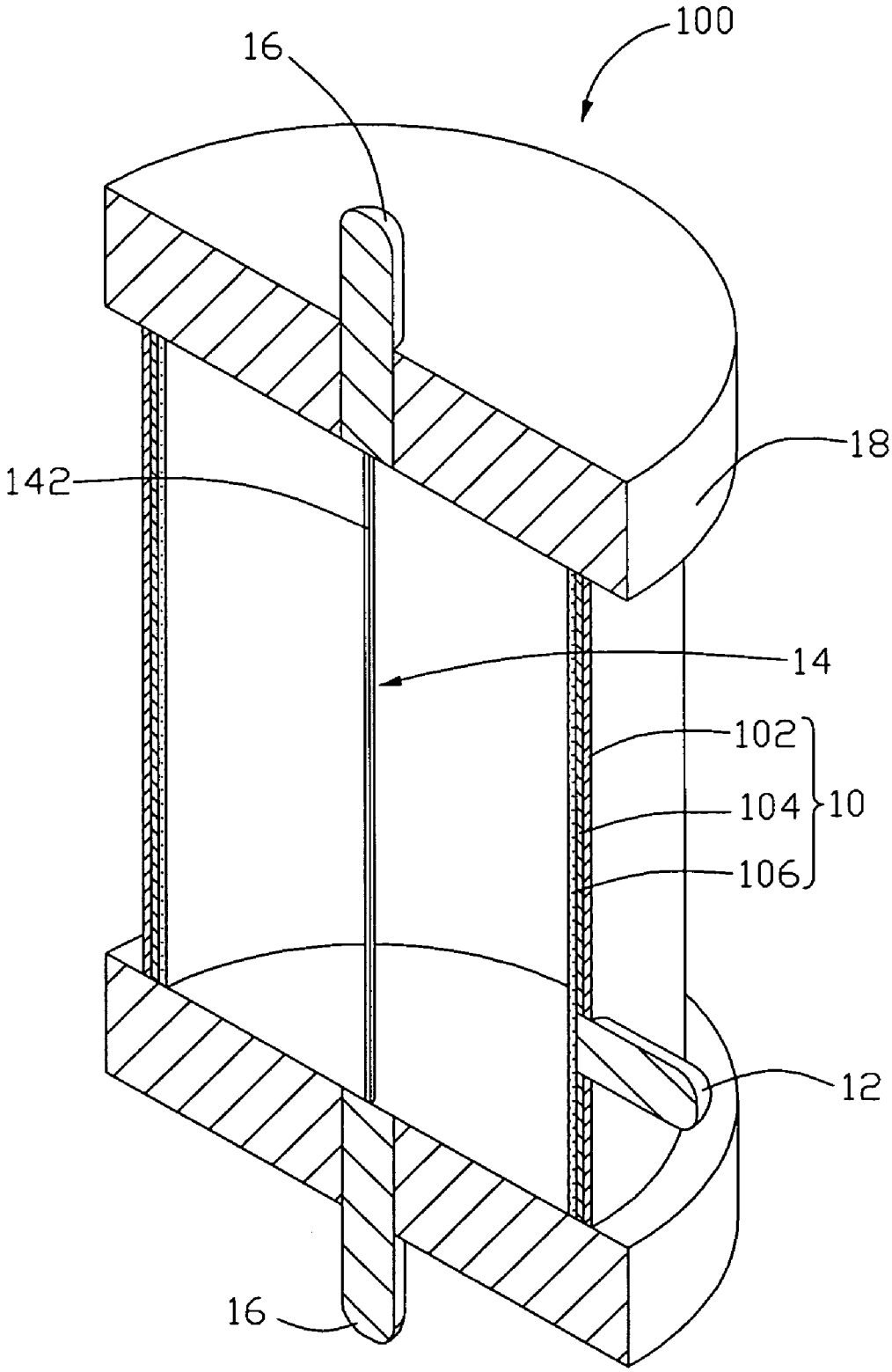
FIG. 1 is a schematic, cut-away view of a field emission illumination device incorporating a carbon nanotube yarn acting as an electron emitting cathode, in accordance with a preferred embodiment.

FIG. 1 illustrates a field emission illumination device 100 in accordance with a preferred embodiment. The field emission illumination device 100 can be used for everyday lighting purposes as well as other illumination applications. The field emission illumination device 100 includes a sealed tubular body 10 and an electron emitting cathode 14.

In this preferred embodiment the sealed tubular body 10 has a light-permeable portion 102 that may be made of glass, plastic etc. An anode layer 104 is formed on an inner surface of the light-permeable portion 102 and a fluorescence layer 106 is formed on the anode layer 104. The anode layer 104 is transparent and includes an electrically conductive material. The electrically conductive material may include tin indium oxide, tin dioxide or other transparent electrically conductive materials. An anode electrode 12 is connected to the anode layer 104 and is supplied with positive charge from a power supply (not shown). In this preferred embodiment, a diameter of the sealed tubular body 10 is in the range from 43 millimeters (hereinafter mm) to 80 mm. A length of the sealed tubular body 10 is in the range from 43 mm to 80 mm. The sealed tubular body further includes two covers 18 at two ends of the light-permeable portion 102 and two cathode electrodes 16. The cathode electrodes 16 are respectively inserted into centers the two covers 18. Two ends of the electron emitting cathode 14 are respectively electrically connected with the two cathode electrodes 16 by glue, and the other ends of the two cathode electrodes 16 are electrically connected with the negative pole of the power supply.

It is to be understood that the dimensions of the sealed tubular body 10 also can be changed according to practical need and the sealed tubular body 10 and the covers 18 can also be integrally formed.

The electron emitting cathode 14 includes a carbon nanotube yarn 142. The carbon nanotube yarn 142 is usually comprised of a plurality of carbon nanotubes parallel to one another and bundled together by van der Waals interactions. The carbon nanotube yarn 142 may have a diameter of no less than about 1 micrometer. A method for fabricating the carbon nanotube yarn 142 can include the following steps of: forming a super-aligned carbon nanotube array, and drawing out a bundle of carbon nanotubes from the super-aligned carbon nanotube array. More detailed information is taught in U.S. Pub. No. 2004/0053780 entitled "Method for fabricating carbon nanotube yarn", which is incorporated herein by reference. Referring to FIG. 1 of U.S. Pub. No. 2004/0053780, it shows that the carbon nanotube yarn is un-twisted. Referring also to the paragraph [0014] of U.S. Pub. No. 2004/0053780, the yarn comprises a plurality of carbon nanotube bundles joined end-to-end in a sort of chain connected by van der Waals attractive force between ends of adjacent bundles. Each of the carbon nanotube bundles includes a number of carbon nanotubes substantially are juxtaposed and parallel to each other. The carbon nanotube yarn 142 may be soaked in water ($H_2O$) or a volatile organic solvent such as, for example, ethanol ($C_2H_5OH$), or acetone ($C_3H_6O$), so as to shrink the carbon nanotube yarn, thereby improving mechanical strength thereof.

It is to be understood that the electron emitting cathode 14 can also be electrically connected with the negative pole of the power supply through one of the two ends of the electron emitting cathode 14.

Figure 2:
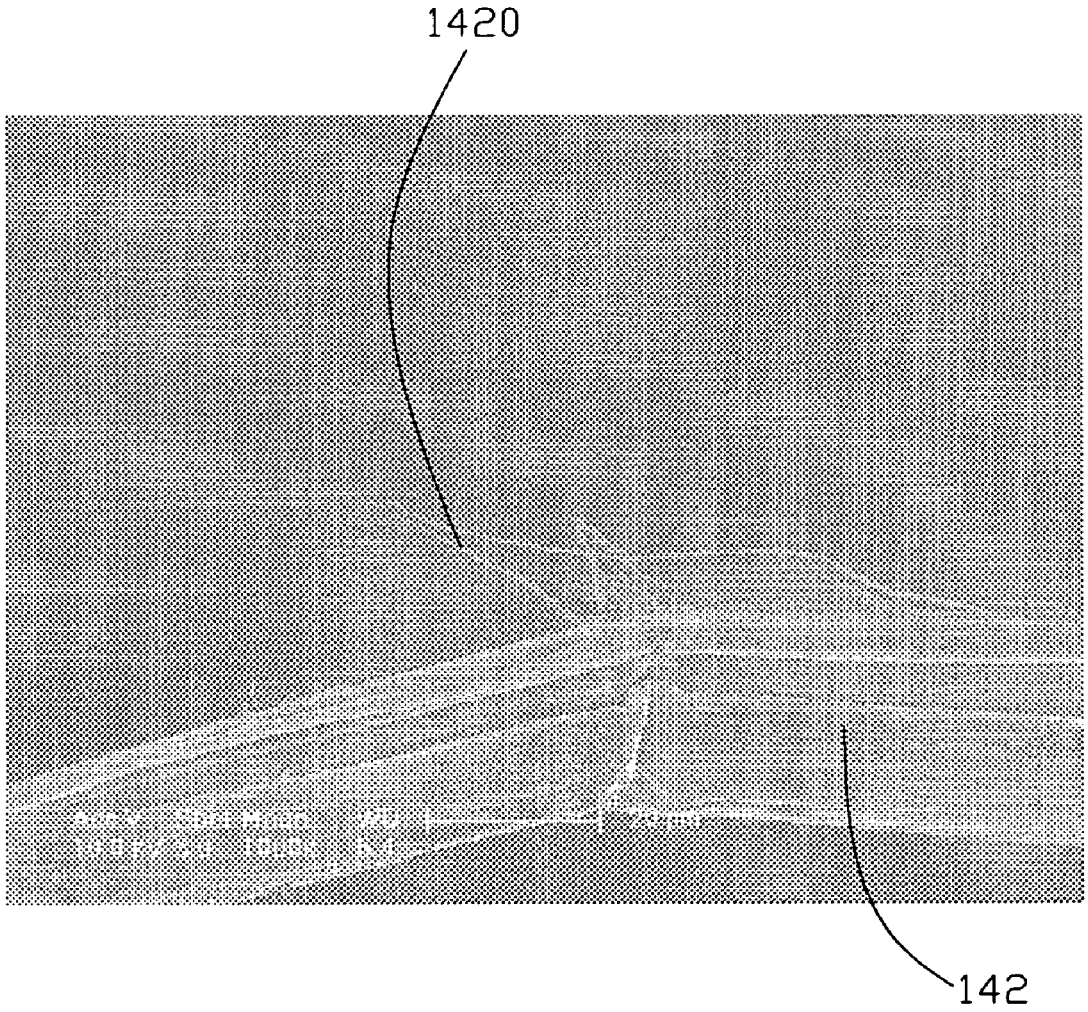
FIG. 2 is a scanning electron microscopy (SEM) image of the carbon nanotube yarn of FIG. 1.

Referring to FIG. 2, the carbon nanotube yarn 142 is bent and has a diameter of about 20 micrometers and a length of about 2 centimeters. As shown in FIG. 2, some carbon nanotubes 1420 protrude from the surface of the carbon nanotube yarn 142. These nanotubes 1420 form electron-emitting tips of the field emission illumination device 100. A diameter of each of the nanotubes 1420 is approximate in a range from 0.4 nanometers (hereinafter nm) to 30 nm.

In this illustrated exemplary embodiment, some working parameters of the field emission illuminating device 100 are provided as follows. An atmospheric pressure of the inner room of the sealed tubular body 10 may be in the order of magnitude of $10^{-4}$ Pascal. A pulse voltage is provided between the anode layer 104 and the electron emitting cathode 14 by the power supply and may have an effective value, pulse frequency and pulse duration of 6000 volt, 1000 Hertz and 2 milliseconds respectively. It is to be understood that the working parameters can be changed according to need. A working principle of the field emission illumination device 100 is described below.

The power supply provides a pulse voltage between the electron emitting cathode 14 and the anode layer 104. The carbon nanotube yarn 142 of the electron emitting cathode 14 is charged in a manner such that it emits a plurality electrons by the pulse voltage; the electrons strike the fluorescent layer 106, which is excited and emits visible light, and the visible light penetrates the anode layer 104 and the transparent body 102 to outside of the sealed tubular body 10 thus providing illumination.

Figure 3:
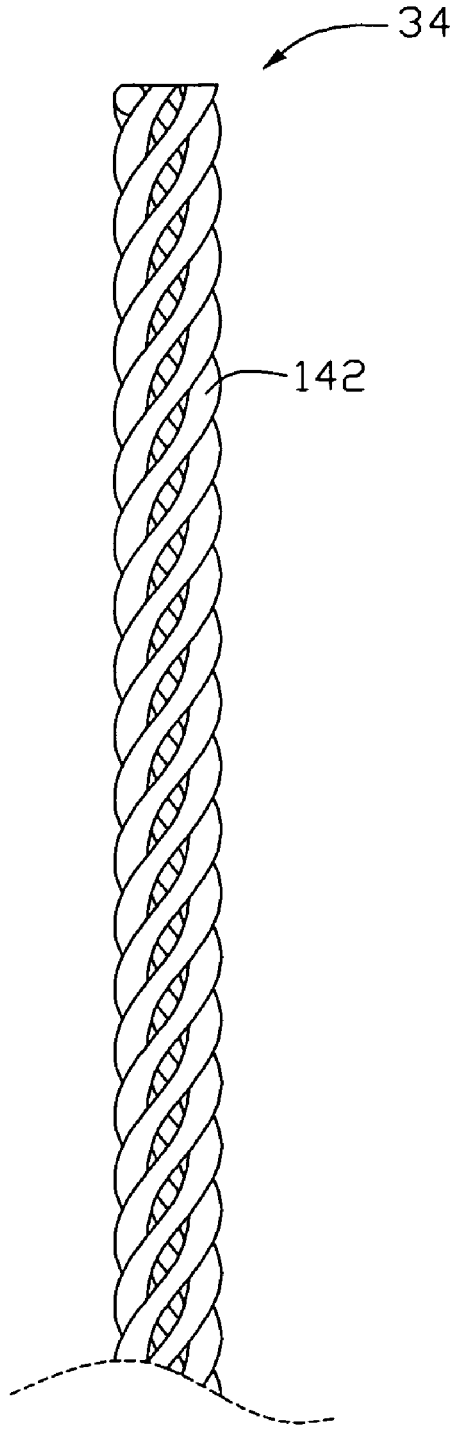
FIGS. 3 to 6 are enlarged views of other alternative embodiments of the electron emitting cathode of the field emission illumination device of FIG. 1
Figure 4:
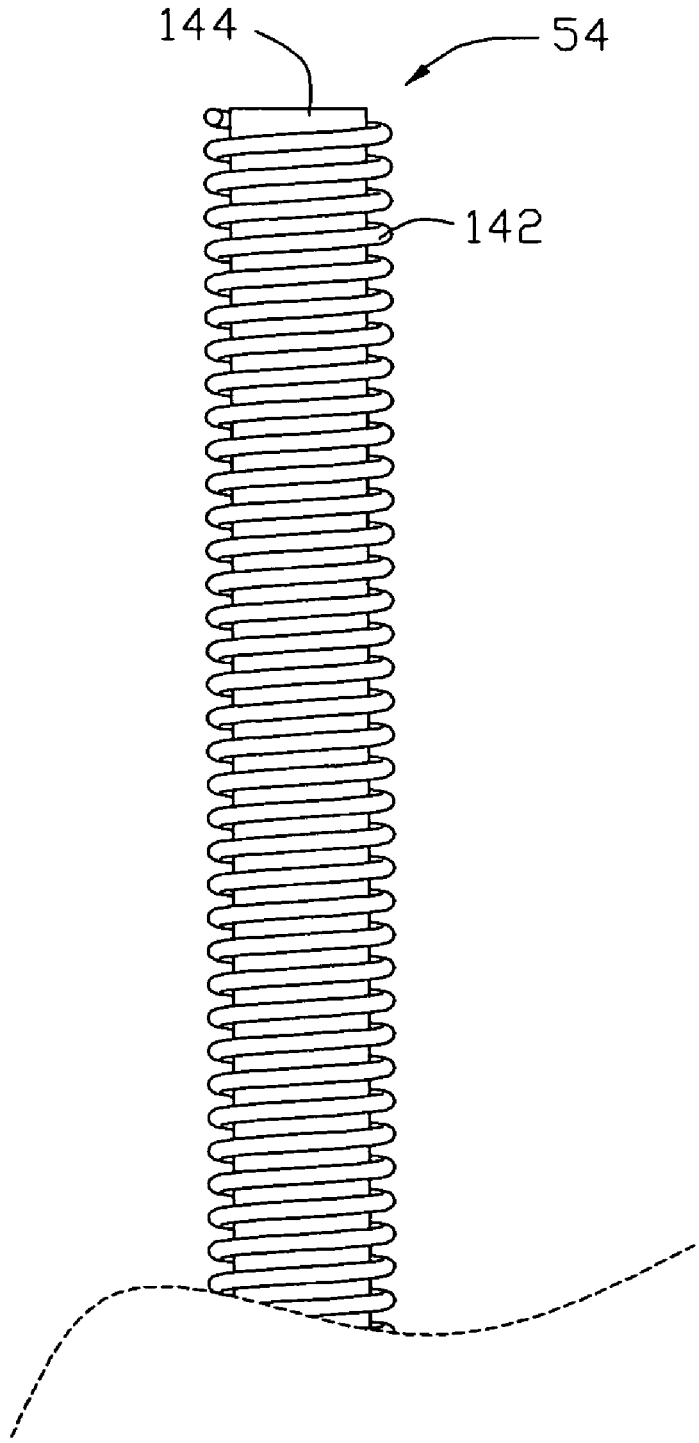
Figure 5:
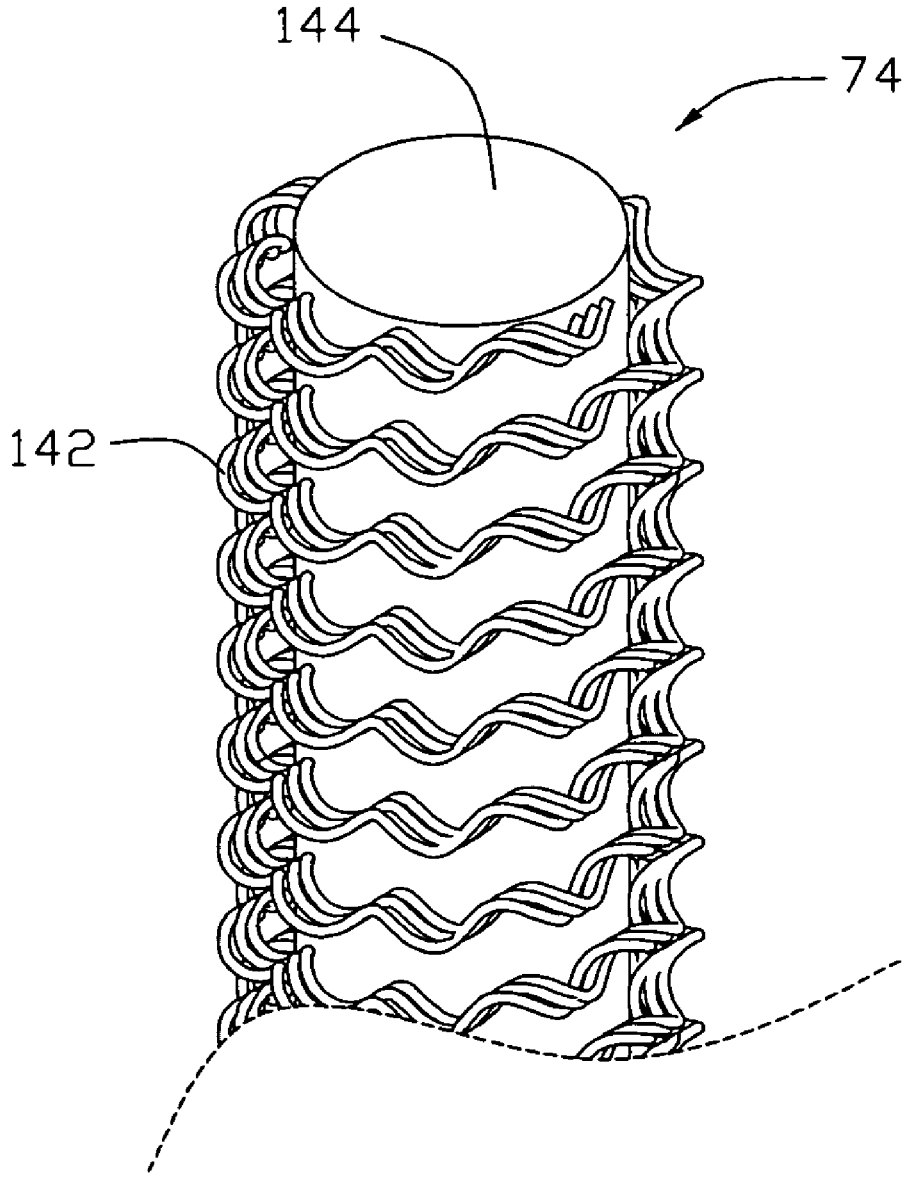
Figure 6:
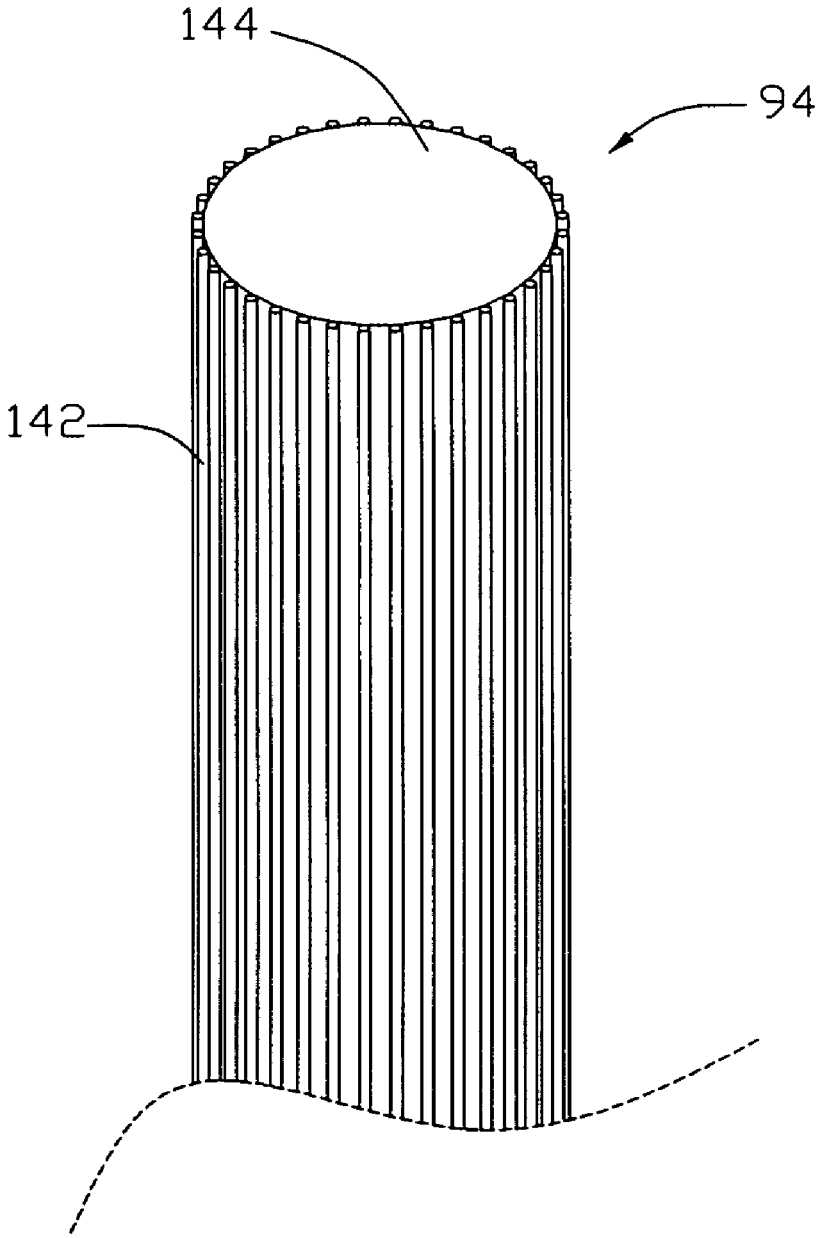

Referring to FIGS. 3 to 6, some other embodiments of electron emitting cathodes are shown. As shown in FIG. 3, an electron emitting cathode 34 includes a carbon nanotube strand formed from the twisted carbon nanotube yarns 142. As shown in FIG. 4, an electron emitting cathode 54 includes a metallic rod 144 and a carbon nanotube yarn 142 coiled around the metallic rod 144. As shown in FIG. 5, an electron emitting cathode 74 includes the metallic rod 144 and the carbon nanotube strand coiled around the metallic rod 144. As shown in FIG. 6, an electron emitting cathode 94 includes the metallic rod 144 and the carbon nanotube yarns 142 glued on the metallic rod 144 and in parallel with each other.

Figure 7:
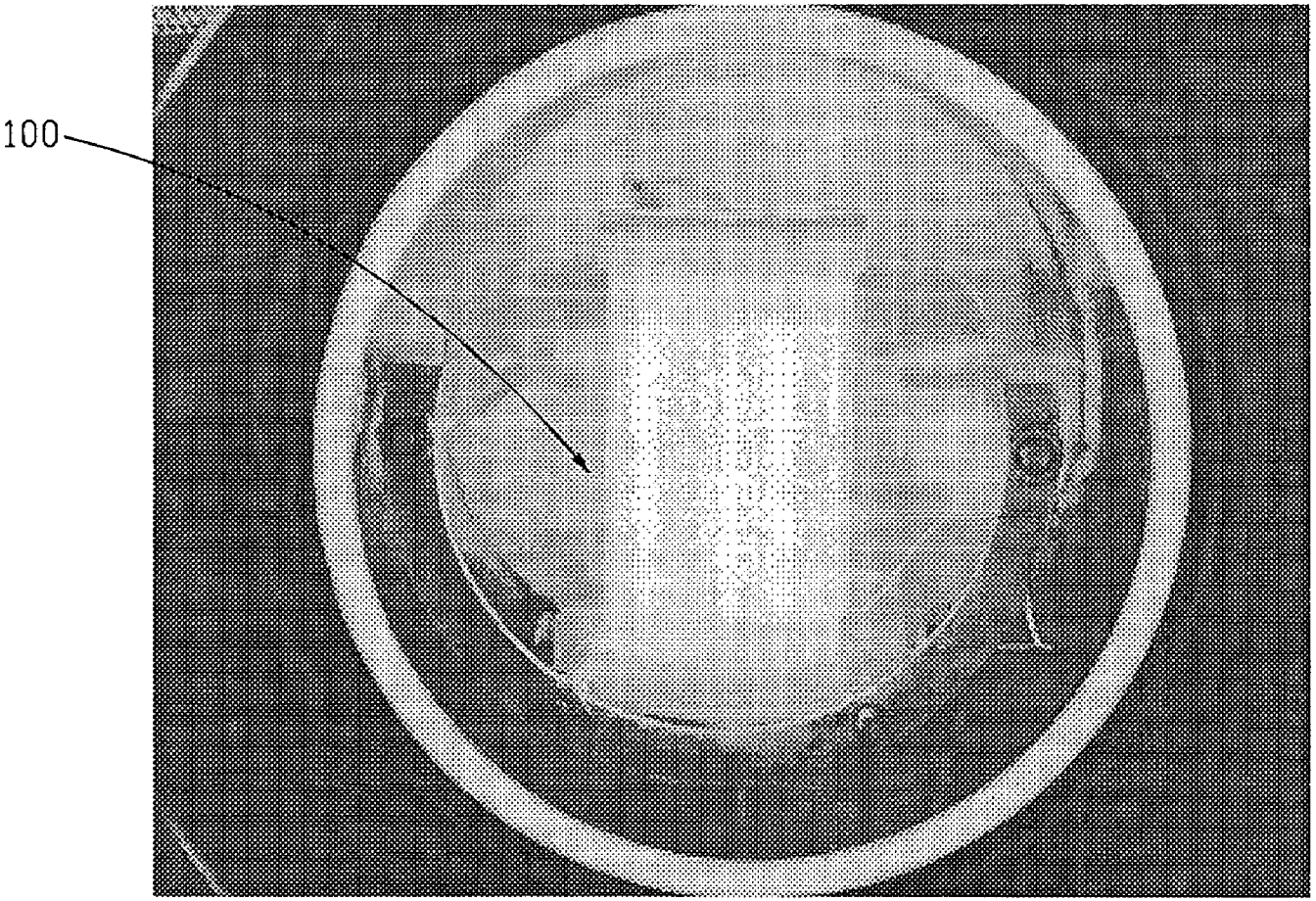
FIG. 7 is an image of the field emission illumination device in accordance with the preferred embodiment of FIG. 1.

Referring to FIG. 7, an image of the field emission illumination device 100 is shown. As shown in FIG. 7, we can see that the field emission illumination device 100 has a good illumination performance compared to the fluorescent lamp.

It is to be understood that a configuration of the sealed tubular body 10 also can be spherical or prism-like etc., and should be considered to be within the scope of the present invention.

The present field emission illumination device 100 has following advantages. The luminescence process of the field emission illumination device 100 only requires one energy transformation process, i.e. that from electric energy to luminous energy, and thus increases the efficiency of energy transformation. In addition, the field emission illumination device 100 doesn't include mercury vapor and is thus more environmentally friendly.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. A field emission illumination device, comprising:

a sealed tubular body having a light-permeable portion;

an anode layer formed on an inner surface of the light-permeable portion of the sealed tubular body;

a fluorescence layer formed on the anode layer;

an electron emitting cathode positioned in the sealed tubular body, the electron emitting cathode comprising at least one un-twisted carbon nanotube yarn, wherein the at least one un-twisted carbon nanotube yarn forms a free-standing structure to longitudinally extend from one end of the sealed tubular body to the other end of the sealed tubular body;

an anode electrode that extends through the light-permeable portion into the tubular body and is in electrical contact with the anode layer; and at least one cathode electrode disposed outside the tubular body and electrically connected with the electron emitting cathode;

wherein the at least one un-twisted carbon nanotube yarn comprises of a plurality of carbon nanotubes substantially parallel to one another and bundled together by Van der Waals interactions.

2. The field emission illumination device as claimed in claim 1, wherein the at least one un-twisted carbon nanotube yarn comprises a plurality of carbon nanotube bundles, adjacent two nanotube bundles being joined with each other at an interface that is perpendicular to the longitudinal direction of the carbon nanotubes of each of the carbon nanotube bundles.

3. The field emission illumination device as claimed in claim 1, wherein the light-permeable portion is comprised of glass or plastic.

4. The field emission illumination device as claimed in claim 1, wherein the anode electrode is substantially perpendicular to the at least one un-twisted carbon nanotube yarn.

5. The field emission illumination device as claimed in claim 1, wherein the electron emitting cathode extends to outside the tubular body, a part of the electron emitting cathode positioned outside the tubular body forms the at least one cathode electrode.

6. A field emission illumination device, comprising:

a tubular body having a light-permeable portion;

an anode layer located on an inner surface of the light-permeable portion of the tubular body;

a fluorescence layer contacting the anode layer;

an anode electrode disposed outside the tubular body and electrically connected with the anode layer;

two cathode electrodes disposed outside the tubular body at opposite ends of the tubular body; and only one carbon nanotube yarn positioned in the tubular body as an electron emitting cathode, wherein two ends of the only one carbon nanotube yarn are electrically connected with the two cathode electrodes respectively and only the one carbon nanotube yarn emits electrons when the field emission illumination device is in use;

wherein the only one carbon nanotube yarn is comprised of a plurality of carbon nanotubes substantially parallel to one another and bundled together by Van der Waals interactions.

7. The field emission illumination device as claimed in claim 6, wherein the only one carbon nanotube yarn extends from one of the two cathode electrodes to the other.

8. The field emission illumination device as claimed in claim 6, wherein the anode electrode extends through the light-permeable portion and the anode layer to contact a surface of the fluorescence layer.

9. The field emission illumination device as claimed in claim 6, wherein the anode electrode extends through the light-permeable portion and the anode layer until reaching the fluorescence layer.

10. The field emission illumination device as claimed in claim 8, wherein the anode electrode is a pole.

11. A field emission illumination device, comprising:

a sealed tubular body having a light-permeable portion;

an anode layer formed on an inner surface of the light-permeable portion of the sealed tubular body;

a fluorescence layer formed on the anode layer;

an electron emitting cathode positioned in the sealed tubular body, the electron emitting cathode comprising at least one un-twisted carbon nanotube yarn, wherein the at least one un-twisted carbon nanotube yarn forms a free-standing structure to longitudinally extend from one end of the sealed tubular body to the other end of the sealed tubular body;

an anode electrode that extends through the light-permeable portion into the tubular body and is in electrical contact with the anode layer; and at least one cathode electrode disposed outside the tubular body and electrically connected with the electron emitting cathode;

wherein the at least one un-twisted carbon nanotube yarn comprises a plurality of carbon nanotube bundles that are joined end to end by Van der Waals forces, and each of the carbon nanotube bundles includes a plurality of carbon nanotubes substantially parallel to each other.

* * * * *